US007765774B2

(12) United States Patent
Mandzsu, Sr. et al.

(10) Patent No.: US 7,765,774 B2
(45) Date of Patent: Aug. 3, 2010

(54) PACKAGING METHODS AND PACKAGING MATERIALS FOR FINE POWDERS

(76) Inventors: József Mandzsu, Sr., Bod Péter Iejtö 4., Budapest (HU) H-1112; József Mandzsu, Jr., Bod Péter Iejtö 4., Budapest (HU) H-1112; Zoltán Mandzsu, Bod Péter Iejtö 4., Budapest (HU) H-1112

( * ) Notice: Subject to any disclaimer, the term of this patent is extended or adjusted under 35 U.S.C. 154(b) by 0 days.

(21) Appl. No.: 11/597,833

(22) PCT Filed: May 26, 2005

(86) PCT No.: PCT/HU2005/000058

§ 371 (c)(1),
(2), (4) Date: Nov. 27, 2006

(87) PCT Pub. No.: WO2005/115855

PCT Pub. Date: Dec. 8, 2005

(65) Prior Publication Data

US 2008/0016825 A1 Jan. 24, 2008

(30) Foreign Application Priority Data

May 27, 2004 (HU) ..... 0401060
May 3, 2005 (HU) ..... 0500435

(51) Int. Cl.
*B65B 31/00* (2006.01)

(52) U.S. Cl. ..... 53/434; 53/447; 383/105

(58) Field of Classification Search ..... 53/434, 53/447, 526, 136.5, 530; 383/32, 105; 414/922
See application file for complete search history.

(56) References Cited

U.S. PATENT DOCUMENTS 2,784,131 A * 3/1957 Fletcher, Jr. ..... 206/503

(Continued)

FOREIGN PATENT DOCUMENTS

DE 3437414 A1 4/1986

(Continued)

OTHER PUBLICATIONS

PCT International Search Report for International Application No. PCT/HU2005/000058, filed May 26, 2005.

(Continued)

*Primary Examiner*—Thanh K Truong
(74) *Attorney, Agent, or Firm*—Duane Morris LLP

(57) ABSTRACT

A method for treating a package. In the method a first plastic film sack (14) is provided, that has a flexible wall (18) comprising a plastic film (3), the wall (18) having an outer surface (5). A second plastic film sack is provided. A product of powder form is provided that has an upper size limit which is the particle size smaller than 1 mass-percent of the particles of the product of powder form, which upper size limit is at most 5000 microns and a lower size limit which is the particle size bigger than 1 mass-percent of the particles of the product of powder form. The product of powder form is packed in the first plastic film sack (14), and the first plastic film sack is, at least partly, placed upon the second plastic film sack. According to the invention, such a first plastic film sack is provided in which at least a part of the outer surface (5) of the flexible wall (18), the roughened surface-part (6), comprises antislip protrusions (7) which antislip protrusions (7) are constituted by roughening particles, of polymer material, fixed to the outer surface (5) and the height (8), above the outer surface (5) of the plastic film wall, of at least a part of the antislip protrusions (7) is bigger than the lower size limit of the product of powder form.

32 Claims, 2 Drawing Sheets

U.S. PATENT DOCUMENTS

| | | | | | |
|---|---|---|---|---|---|
| 2,917,223 | A | * | 12/1959 | Le Bolt et al. | 383/32 |
| 3,283,992 | A | * | 11/1966 | Hanson et al. | 383/32 |
| 3,760,940 | A | * | 9/1973 | Bustin | 383/35 |
| 3,904,465 | A | * | 9/1975 | Haase et al. | 156/199 |
| 4,011,358 | A | * | 3/1977 | Roelofs | 428/516 |
| 4,085,851 | A | * | 4/1978 | Young | 206/554 |
| 4,488,918 | A | | 12/1984 | Jofs et al. | |
| 5,094,902 | A | * | 3/1992 | Haenggi et al. | 428/150 |
| 5,204,159 | A | * | 4/1993 | Tan | 428/143 |
| 5,227,221 | A | * | 7/1993 | Hedblom | 428/172 |
| 5,536,569 | A | * | 7/1996 | Lasch et al. | 428/328 |
| 5,601,900 | A | * | 2/1997 | Doscher | 428/149 |
| 5,614,288 | A | * | 3/1997 | Bustos | 428/167 |
| 5,787,655 | A | * | 8/1998 | Saylor, Jr. | 52/181 |
| 6,132,780 | A | * | 10/2000 | Archibald et al. | 426/106 |
| 6,378,272 | B1 | * | 4/2002 | Archibald et al. | 53/412 |
| 6,444,080 | B1 | * | 9/2002 | Mandzsu et al. | 156/276 |
| 6,471,402 | B1 | * | 10/2002 | Burns | 383/32 |
| 6,509,084 | B2 | * | 1/2003 | Sturtevant et al. | 428/141 |
| 2004/0115400 | A1 | * | 6/2004 | Lefebvre et al. | 428/143 |

FOREIGN PATENT DOCUMENTS

| | | |
|---|---|---|
| DE | 19938828 A1 | 1/2001 |
| WO | 98 34775 | 8/1998 |

OTHER PUBLICATIONS

PCT Written Opinion of the International Searching Authority for International Application No. PCT/HU2005/000058, filed May 26, 2005.

PCT International Preliminary Report on Patentablility for International Application No. PCT/HU2005/000058, filed May 26, 2005.

* cited by examiner

PACKAGING METHODS AND PACKAGING MATERIALS FOR FINE POWDERS

This application is a National Stage of International Application No. PCT/HU2005/00058, filed on May 26, 2005, published in English, and incorporated herein by reference, which claimed priority benefits of Hungarian Application P0500435, filed on May 3, 2005, and Hungarian Application P0401060, filed on May 27, 2004.

TECHNICAL FIELD

The invention relates to skidproof plastic film packaging means and their use for packaging products comprising fine powders.

BACKGROUND OF THE INVENTION

In the industry, bulk solid powder products, comprising fine granules, are in big quantities packed up in sacks of 5 to 50 kilograms. Examples of products of that kind are cement, the so-called dry-mixes including cement or lime powder (e.g. dry-mortar, dry concrete-mix), limestone-powder, lime-hydrate powder, polymer powders (e.g. suspension poly-vinylchloride, S-PVC) etc. For the bagging of these products, easily mixing with air, typically paper sacks of porous walls, particularly valve bags, are used. It would be cheaper to use plastic packaging film for the automatic bagging of the fine powders, e.g. cement mixes. That can be done, for example, with the packaging machine called "Compacta for Cement", made by Italian company "BL Bagline", representing the state of the art. Still, the packaging of fine powders into plastic sacks has not become widespread. We have found that one, maybe the most important, reason thereof is that if fine granulated products are packed in traditional plastic film bags, then the stability of the stacks built from the bags is insufficient, the bags slip apart. That is, on the one hand, caused by the coefficient of friction of the smooth surface of the ordinary plastic film being generally lower than that of the usual paper grades, especially if the film is polluted with fine dust. On the other hand, the wall of the plastic film bag, unlike that of a paper bag, is not porous. Therefore a certain airing can at most be provided with perforating the surface of the film, during the filling-in of the powder-air mixture. A relatively fast airing can usually be achieved with vent hole perforations of at least about 3 to 4 mm's, but even that is less than sufficient. Because of the insufficient airing, the bags remain "inflated", containing surplus air, even when they get into, and become a part of, a stack of bags. There are air cushions left in the inflated bags lying upon each other which, in the case of plastic films used so far for this purpose, makes the stack unacceptably unstable and the bags slip up on each other and fall from the pallet. All that prevents inexpensive plastic packaging films from being used with products of fine granules.

There has traditionally been an endeavour to decrease the slip of plastic bags by increasing the coefficient of friction of the film of the bags. Therefore, in accordance with the solution of the company Nordenia Kunststoffe, published in document DE 3437414A1, the wall of the plastic bag has been strongly embossed, from inside out, thus forming in the film hollow protrusions protruding to the outside. There has been an endeavour to form high and sharp protrusions by embossing the film which, however, weakens the film. According to our own measurements, such a strong embossing may decrease the breaking strength of the film by up to 14.5%, which increases the danger of the bursting of the inflated bag being in the stack. Therefore we deem embossing a disadvantageous solution in this field of packaging. At the same time, however, in a heavily dusty environment the beneficial effects of the embossing to the coefficient of friction of the film are negligible. The coefficient of friction of plastic films easy to emboss, rich in special low density polyethylenes, is usually low anyway. In addition, the hollow embossing, under the heavy load of the cement bags, will soon flatten out and get planar.

It is, on the other hand, known that U.S. Pat. No. 6,444,080, originating from the present applicants, is related to plastic films, of decreased slip, for making sacks between which the clinging is not primarily provided by the usual static coefficient of friction. In that solution at least one of the sliding film surfaces is rough, and its roughening protrusions interact with an engaging element of a loose, fibrous structure, practicably with an inexpensive nonwoven fabric, in a way by which a bond, of a strong shear strength, can be provided between the engaging element and the rough film or films. The essence therein is that the antislip protrusions are capable of penetrating between the free filaments, therefore the adhesion is not only based on the coefficient of friction of the materials but rather on a kind of a mechanical lock effect. According to the document (and to our own experience) the adhesion can be further increased if the antislip protrusions are undercut, i.e., their projection to the surface of the film is bigger than their intersection with the plane of the film.

This kind of film-roughening has, over other kinds of film roughening methods, the distinguishing feature that the roughening protrusions are formed with fixing powder granules or other, essentially point-like, particles to the film and preferably have a typical undercut. Thus these protrusions are not mere embossed protrusions but they add extra material to the film therefore they do not essentially weaken the film. These protrusions are thus of essentially point-like topology in comparison with the protrusions of such other kinds of roughening in which the protrusions are long, straight lines or ridges and valleys of linear topology, winding in a random manner.

In our experience the aforementioned antislip solution, comprising rough film and engaging element, has worked very well and reliably in practice with skidproof packaging of pellets, and it can be used in several ways. In one possible solution at least the upper surfaces of the sacks, laid upon each other, are rough and at least their lower surfaces are provided with an engaging element, for example a nonwoven fabric, fixed thereto (the roles of the upper and lower surfaces can be inverted). The engaging element can be fixed to the sacks before, during or after the filling. Here the sacks must be stacked in a brick-like bond. In another solution both the lower and upper surfaces of the bags are rough, and the engaging element, for example nonwoven fabric, is present in the form of a stick-sheet laid between the layers of bags. The latter arrangement provides the advantage that the bags do not have to be stacked in a brick-bond pattern but they can also be arranged in columns and that in many cases it is not necessary to apply an engaging sheet to every layer (source reduction). It is a further advantage of the latter arrangement that the different polymer materials of the system (nonwoven fabric and bags) can easily be separated with a view to a recycling.

The requirement of a good printability of the rough sack surface prompts the skilled person to use antislip protrusions as small and as low as possible. The same urge originates from a further advantage of the lower protrusions, that the surface of such bags is more comfortable to touch, is not so rough, which is very important for many smaller industrial users (for those whose workers move the bags by hand and a too abrasive rough film surface might hurt their skin).

That method or such film bags are not known, from the prior art, to be used in the field of packaging fine powder products.

DISCLOSURE OF THE INVENTION

Our main objective is to provide solutions (packaging methods, packages and packaging means) that make it possible to use the more economical plastic film packaging with fine powdery products with security. Our particular objective is to combine the non-slip system, comprising rough film and fibrous engaging element, with the packaging of fine powders in such new ways which particular combinations provide surprising, advantageous results and unexpected effects.

We have discovered that the roughened plastic sacks provided with engaging elements in accordance with the aforementioned U.S. Pat. No. 6,444,080 patent provide, in case of favourable circumstances, so strong skidproofing even in a dusty, contaminated state which even makes stacks comprising inflated bags completely safe. We, however, have recognised that in order of our objective, the rough film must fulfill further special criteria if applied with fine powders. The thing is that the "rough film and engaging element" system, working reliably under circumstances free of fine powders (e.g., at the packaging of pellets), will, in the presence of fine powders, sometimes work perfectly but may, at other times, go wrong unexpectedly and unnoticed.

The fine powder, constituting the contents, may, during the packaging, e.g., during or after the filling of the packages, or during the stacking or during a successive transportation, get to the outer, rough side of the packaging film, either from the ambient air or from the filled sack, through its airing orifices. That, depending on conditions not published so far, influences, apparently unpredictably, the engagement between the rough film surface and the engaging element and thereby the stability of the stack. In unfavourable circumstances the dust, being on the outer, rough surface of the bag, may fill the space between the protrusions and impede the engaging fibres penetrating and hooking there. That may make the quality of the skidproofing unpredictable, unreliable and dependent on time. As we have recognised, the, otherwise excellent, skidproofing effect provided by the antislip protrusions and the fibrous engaging element can deteriorate if the protrusions applied are too low as compared to the size of the granules of the dust getting to the rough outer surface of the film. If, however, the protrusions are sufficiently high, the skidproofing will reliably be sustained.

Under a certain particle size, in case of fine powders, at filling powdery products into plastic sacks there is a risk of the relatively smallest particles of the powder, belonging to its finest fraction, flying away and mixing with the ambient air. In order that not too much powder escapes, the filling is usually done with suitable care (e.g., with a filling spout moved during the filling from the bottom of the bag toward its top) and suitably slowly. That, in practice, will mean that the bags are filled at a speed at which a part of just the smallest powder particles fly away in the ambient air. For example, during the filling of valve bags the fine powder will escape next to the valve while with form-fill-seal (FFS) machines some fine powder puffs out at the open mouth of the bag. All that does not depend on whether the wall of the bag is perforated, breathing, or not. In unfavourable circumstances, the fine dust settling from the air, during or after the packaging, onto the bags, being just filled or already filled, can fill the space between the protrusions and can make it difficult for the engaging fibres to enter there. That makes the quality of the skidproofing unreliable and dependent on time.

It is, even with highly automated packaging, common that the process of packaging and stacking is interrupted, for some reasons, for some time (e.g., for some minutes or even for several hours). In that case the time, elapsed till two packages, to be put on top of each other, are actually laid on each other, is lengthened and during that time somewhat more airborne dust settles, from the ambient air, to the lower package than usual. In unfortunate circumstances that can lead to the antislip effect, between the two packages, disappearing unnoticed and completely. That creates a sneaking, slippery abutment inside the stack, between its two neighbouring layers, one being above the other, which of course endangers the security of the whole stack. That phenomenon is surprising because the filled packages, of apparently dusty surface, put on top of each other with the usual time period stick to each other perfectly, but the special, fine-powdery circumstances involve a surprising and unexpected time-factor into the behaviour of the product, making the same dependent on time, whose considering is not obvious for the skilled person.

The slip-preventing effect provided by the antislip protrusions and the fibrous engaging element can deteriorate if the protrusions applied are too low as compared to the size of the fine fraction of the powder filled in. If, however, the protrusions are high enough, the skidproofing will be securely maintained.

The essence of our respective invention is a method for treating a package, in which

- a first plastic film sack is provided,
  - the first plastic film sack having a flexible wall comprising a plastic film,
    - the wall having an outer surface,
- a second plastic film sack is provided, and
- a product of powder form is provided that has
  - an upper size limit which is the particle size smaller than 1 mass-percent of the particles of the product of powder form, which upper size limit is at most 5000 microns and
  - a lower size limit which is the particle size bigger than 1 mass-percent of the particles of the product of powder form,
- the product of powder form is packed in the first plastic film sack, and
- the first plastic film sack is, at least partly, placed upon the second plastic film sack, in which method, in accordance with the invention, such a first plastic film sack is provided in which at least a part of the outer surface of the flexible wall, the so-called roughened surface-part, comprises antislip protrusions which antislip protrusions are constituted by roughening particles (preferably granules), of polymer material, fixed to the outer surface and the height, above the outer surface of the plastic film wall, of at least a part of the antislip protrusions is bigger than the lower size limit of the product of powder form.

The first plastic film sack can be a pillow sack, a side gusseted sack, a valve sack or any suitable sack. Its substance is typically polyolefine, e.g., polyethylene, but can also be something else. The plastic film of the sack can comprise one layer or multiple layers. It can also be the case that the plastic film of the sack is a material woven from strips slit from single- or multilayer films during the manufacture of which the film, made with extrusion, is slit into narrow strips and a fabric is made from the strips, for example with circular weaving or flat weaving. The sack can, for example, be welded and/or adhered and/or sewn. The second plastic film sack can be similar to or different from the first one.

The size of a particle is its biggest extent. The product of powder form is packed in the first plastic film sack which means that it is filled into the film sack (for example, with gravity force or with casting with impulse or, mixed with air, with blowing etc.) and the film sack is preferably suitably closed as necessary, for example its open mouth is closed with welding or its filling valve is closed with laying down the sack. The surface part provided with antislip protrusions, the so-called roughened surface part, can preferably decrease the slip interacting with an engaging element of a fibrous structure, e.g., with a nonwoven fabric. The protrusions are solid and were made with fixing plastic particles (e.g., plastic powder particles) to the outer surface. That, on the one hand, provides a suitable geometry, sticking out, of the protrusion, while, on the other hand, makes it possible that the material of the particles and that of the film be different. The roughening protrusions are preferably granules but the final shape of the protrusions may be different from a usual granule shape, it may be more or less impressed, smeared, stretched etc., showing a result of the manufacturing process. The way of their fixation may be welding or adhering or any other suitable way. It is an essential element of the invention that at least a part of the protrusions is higher than the lower size limit of the powdery contents. It is an advantage of the method that it resists the harmful effect, cumulative in time and spoiling the skidproofing, of the fine dust settling from the air.

We have recognised that, in order of a very strong non-slip bond with the fibres of the engaging element of a fibrous structure, it is further preferable if the granules of the fine dust, potentially settling on the outer surface of the film between the antislip protrusions, are smaller than the height, above the outer surface of the film, of the side edge, widest point, of the undercut antislip protrusion. In this case the fibres of the engaging element slip into the undercut of the protrusion, e.g., to the foot of the protruding granule, to the section line of the granule and the film and get fixed there with a mechanical locking. Therefore it is preferable if in the aforementioned method such a first plastic film sack is provided in which, in at least one vertical section taken during a horizontal state of the outer surface, of at least a part of the antislip protrusions, one or both of the leftmost and rightmost points of the antislip protrusion are at a greater free distance from the outer surface than the lower size limit of the product of powder form. The benefit of the method is that this way a layer of the fine powder settling can not prevent the engaging fibres from hooking with the lower, undercut portions of the protrusions.

It is, with respect to skidproofing, preferable if in the aforementioned methods such a skidproofing material, of a suitable loose fibrous structure and inherent strength (preferably a nonwoven fabric), is provided, at least partly placed between the film sacks, which is capable of a suitable nonslip bond with the antislip protrusions due to its containing the elementary filaments or yarns in such a density and layer thickness at which a mechanical bond is formed between its elementary filaments or yarns and the antislip protrusions.

The point is that the antislip protrusions are able to penetrate between the free fibres and that is how a solid mechanical bond, in shearing direction, is formed. In order of an increased effective surfacial friction it is preferable if both film sack walls, contacting each other with the mediation of the skidproofing material, are roughened, but if that can not be provided then it is preferable to fix the skidproofing material to the non-roughed sack wall. In one practicable embodiment of the method the film sacks, roughened both on their upper and lower main surfaces, are stacked in multiple layers on a pallet, and one or more or every boundary surface between the layers is filled, entirely or partly, with a skidproofing material of a suitable looseness and tear strength (preferably with a nonwoven fabric). That can, for example, be performed with laying, right after placing the layers of sacks, on the top of the respective sacks a nonwoven fabric of a size approximately equal to the area of the pallet.

The filled package, utilised in the aforementioned method, inherently possesses the advantages originating in the invention, because from such packages a stable stack can be built in several ways, with a suitable engaging element of fibrous structure (e.g., with stick-sheets of fibrous structure, for example of nonwoven fabric, laid between the layers of the stack).

Thus the essence of our respective invention is a package, comprising a plastic film sack and a product of powder form packed therein, the plastic film sack having a flexible wall comprised of a plastic film, the wall having an outer surface, the product of powder form having an upper size limit which is the particle size smaller than 1 mass-percent of the particles of the product of powder form, which upper size limit is at most 5000 microns and a lower size limit which is the particle size bigger than 1 mass-percent of the particles of the product of powder form, which package is, in accordance with the invention, such as at least a part of the outer surface of the flexible wall of its plastic film sack, the so-called roughened surface-part, comprises antislip protrusions which antislip protrusions are constituted by roughening particles (preferably granules), of polymer material, fixed to the outer surface and the height, above the outer surface of the plastic film wall, of at least a part of the antislip protrusions is bigger than the lower size limit of the product of powder form.

The advantage of the package is that it resists the harmful effect, cumulative in time and spoiling the skidproofing, of the fine dust settling from the air.

Analogously, it is preferable if the aforementioned package is such as in at least one vertical section taken during a horizontal state of the outer surface, of at least a part of the antislip protrusions of its plastic film sack, one or both of the leftmost and rightmost points of the antislip protrusion are at a greater free distance from the outer surface than the lower size limit of the product of powder form. The benefit of such a package is that this way a layer of the fine powder settling can not prevent the engaging fibres from hooking with the lower, undercut portions of the protrusions.

It is, with respect to skidproofing, preferable if the aforementioned package is such as it has a skidproofing material of a suitable loose fibrous structure and inherent strength (preferably a nonwoven fabric), placed suitably to the outer surface of its plastic film sack, which is capable of a suitable nonslip bond with the antislip protrusions due to its containing the elementary filaments or yarns in such a density and layer thickness at which a mechanical bond is formed between its elementary filaments or yarns and the antislip protrusions.

For a skilled person, the aforementioned U.S. Pat. No. 6,444,080 and our own comments added thereto hereinabove provide sufficient teaching as concerning a suitable placing and, in case of necessity, fixing of the skidproofing material as an engaging element. The skidproofing material, capable of forming a mechanical bond, provides its beneficial, stabilising effect when the package is put into a stack, forming a mechanical bond with the antislip protrusions of packages, similar to and neighbouring with the package.

At places where such a product of powder form is packed in plastic sacks which powder has a component of a size smaller than 3 microns, it is, in our experience, essentially almost impossible to prevent the very tiny dust granules from unnoticedly escaping, rising in the air and later settling to the surface of the sacks already filled. The very fine dust settling on the surface of the sack, in a layer thicker and thicker by time, will dramatically decrease the skidproofing between the antislip protrusions and the fibrous engaging element after a certain time, because it fills the space between the protrusions and makes it difficult for the engaging fibres to enter there. That makes the quality of the skidproofing unreliable and dependent on time. That can be avoided with applying suitably high antislip protrusions. The essence of our respective invention is a method for treating a package, in which a first plastic film sack is provided, the first plastic film sack having a flexible wall comprising a plastic film, the wall having an outer surface, a second plastic film sack is provided, and a product of powder form is provided that comprises, at least partly, particles smaller than 3 microns, the product of powder form is packed in the first plastic film sack, and the first plastic film sack is, at least partly, placed upon the second plastic film sack, in which method, in accordance with the invention, such a first plastic film sack is provided in which at least a part of the outer surface of the flexible wall, the so-called roughened surface-part, comprises antislip protrusions which antislip protrusions are constituted by roughening particles (preferably granules), of polymer material, fixed to the outer surface and the height, above the outer surface of the plastic film wall, of at least a part of the antislip protrusions is bigger than 12 microns.

The meanings of several words of the invention have already been defined hereinabove. The product of powder form may also comprise particles bigger than 3 microns; it, however, surely contains particles smaller than 3 microns, too.

The advantage of the method is that it resists the harmful effect, cumulative in time and spoiling the skidproofing, of the fine dust settling from the air.

Analogously, it is preferable if in the aforementioned method such a first plastic film sack is provided in which, in at least one vertical section taken during a horizontal state of the outer surface, of at least a part of the antislip protrusions, one or both of the leftmost and rightmost points of the antislip protrusion are at a greater free distance from the outer surface than 12 microns. The benefit of the method is that this way a contaminating layer of the extremely fine powder settling can not prevent the engaging fibres from hooking with the lower, undercut portions of the protrusions.

It is, with respect to skidproofing, preferable if in the aforementioned methods such a skidproofing material, of a suitable loose fibrous structure and inherent strength (preferably a nonwoven fabric), is provided, at least partly placed between the film sacks, which is capable of a suitable nonslip bond with the antislip protrusions due to its containing the elementary filaments or yarns in such a density and layer thickness at which a mechanical bond is formed between its elementary filaments or yarns and the antislip protrusions.

Details of this have already been discussed in relation to the above described, analogous solution.

Analogously, the package mentioned in the previous method is also in itself an advantageous invention.

Thus the essence of our respective invention is a package, comprising a plastic film sack and a product of powder form packed therein, the plastic film sack having a flexible wall comprised of a plastic film, the wall having an outer surface, and the product of powder form comprising, at least partly, particles smaller than 3 microns, which package is, in accordance with the invention, such as at least a part of the outer surface of the flexible wall of its plastic film sack, the so-called roughened surface-part, comprises antislip protrusions which antislip protrusions are constituted by roughening particles (preferably granules), of polymer material, fixed to the outer surface and the height, above the outer surface of the plastic film wall, of at least a part of the antislip protrusions is bigger than 12 microns.

The advantage of the package is that such a stack can be built therefrom as resists the harmful effect, cumulative in time and spoiling the skidproofing, of the fine dust settling from the air.

Analogously, it is preferable if the aforementioned package is such as in at least one vertical section taken during a horizontal state of the outer surface, of at least a part of the antislip protrusions of its plastic film sack, one or both of the leftmost and rightmost points of the antislip protrusion are at a greater free distance from the outer surface than 12 microns. The benefit of such a package is that this way a contaminating layer of the extremely fine powder settling can not prevent the engaging fibres from hooking with the lower, undercut portions of the protrusions.

It is, with respect to skidproofing, preferable if an aforementioned package is such as it has a skidproofing material of a suitable loose fibrous structure and inherent strength (preferably a nonwoven fabric), placed suitably to the outer surface of its plastic film sack, which is capable of a suitable nonslip bond with the antislip protrusions due to its containing the elementary filaments or yarns in such a density and layer thickness at which a mechanical bond is formed between its elementary filaments or yarns and the antislip protrusions.

A suitable placing and fixing of the skidproofing material, as an engaging element, have already been mentioned hereinabove.

As it has, in the description of the prior art, been mentioned, the harmful quantity of air closed into the bags can, to a certain extent, be decreased with applying perforated packaging films or film sacks, provided with airing orifices. During stacking and the treating, moving, transporting of the sacks, powder gets out, through the airing orifices of the perforated plastic film sacks, to the outside of the sack right around the orifices, causing surfacial contamination. In this case, the rougher fractions of the product of powder form, otherwise not so easily mixing with the air, can also get out through the orifices. The quantity and fraction size of the powder, seeping out and polluting the outer surface, may typically depend on the way of a successive moving of the completed packages or a successive transportation of the completed stacks. The powder of a relatively big size and big quantity, seeping out, behaves similarly to bearing balls and contributes to the slipping up of traditional sack surfaces. We have discovered that under disadvantageous circumstances the effectiveness of the skidproofing of film sacks, roughened with antislip protrusions and provided with airing orifices, formed with the engaging element of a fibrous structure will, surprisingly enough, sensitively depend on the size of the granules of the aforementioned polluting powder getting to the surface of the sack. If the granules of the polluting powder are too big as compared to the particles constituting the roughening protrusions then the skidproofing deteriorates, while with polluting powder granules of a smaller size the skidproofing will be maintained. That may render the skidproofing system unreliable since it makes the degree of skidproofness depend on the way of the stacking, for example on to what an extent, during the stacking or a successive transportation, the individual sacks are shaken or compressed thus how many and how big dust granules are pressed out of them through the airing orifices. The reason thereof is certainly that the bigger granules can better fill in the space between the antislip protrusions and thereby they worsen the penetration of the antislip protrusions between the fibres of the engaging element. Such a distinction can not be experienced in case of traditional (i.e., not roughed) perforated film sacks, as in their case both the rougher and finer fractions of the dust granules, getting out through the airing orifice and settling directly on the film, make the surface of the sacks slippery, similarly to bearing balls. It is our object to present such an application of the skidproofing system, consisting of rough and fibrous components, as eliminates the unreliability originating from the aforementioned sensitivity.

The powder, being in the sack and flowing out through the airing orifice, partly fills, and blocks up, the inside of the airing orifice thus soon such a state develops in which a hole, much smaller than the airing orifice, is maintained for the granules to flow out through. Thus, in the end, only particles much smaller than the airing orifice flow out from the sack in bigger quantities. We have recognised that if such a sack is applied for packing fine powder whose airing orifices are not too big as compared to the antislip protrusions then it will help maintain the effectiveness of the skidproofing system, comprised of rough and fibrous components, during the stacking and a successive transportation. As concerning the disadvantageous effect of a possibly too poor airing-out, as a result of the too small airing orifices, it can be well balanced with the skidproofing system of rough film and engaging element. Thus the essence of our invention is a method for treating a package, in which

- a first plastic film sack is provided,
  - the first plastic film sack having a flexible wall comprising a plastic film,
    - the wall having an outer surface, and
    - the wall having at least one airing area comprising airing orifices, of suitable size and closeness, penetrating through the wall, and
- contents of powder form, packed in the first plastic film sack, are provided, and
- a second plastic film sack is provided, and
- the first plastic film sack is, at least partly, placed upon the second plastic film sack, in which method, in accordance with the invention, such a first plastic film sack is provided in which at least a part of the outer surface of the flexible wall, the so-called roughened surface-part, comprises antislip protrusions which antislip protrusions are constituted by roughening particles (preferably granules), of polymer material, fixed to the outer surface and the height, above the outer surface of the plastic film wall, of at least a part of the antislip protrusions is bigger than one fortieth (preferably one thirtieth, more preferably one twentieth, even more preferably one tenth) of the size of at least a part of the airing orifices.

The meanings of several words of the invention have already been defined in detail, hereinabove. The sack may have one or more airing areas, of suitable size and location, depending on the particular application. There are airing orifices in the airing area, in which the essence is that they, penetrating through the wall of the sack, are capable of leading the air out from within the sack. These can be, for example, pinholes pricked with cold or hot pins, or slit openings, or apertures formed, during the weaving, between the fibres of the woven material etc. Knowing the particular application, the skilled person can use airing orifices of a suitable size and closeness which let out much enough of the air but sufficiently retain the contents. The contents of powder form are packed into the film sack, i.e., the sack contains the contents, and the sack is preferably closed but it can be open as well. The contents of powder form may be of any kind suitable for packing in a film sack. The contents of powder form are preferably constituted by a powder mixed with air. The second plastic film sack can be similar to or different from the first one and it can also be airing.

It is important that the airing orifices should be small enough and of a sufficiently low closeness in order that the tearing parameters (primarily e.g., the tear strength) of the flexible wall remain good enough even in the airing area. The size of the airing orifice is the biggest extent of the airing orifice taken in a view from a direction normal to the outer surface. It is, for example, in case of an orifice of circular shape the diameter of the circle. The height of the protrusion is thus greater than the size of the airing orifice divided by forty. The advantage of the method is that the skidproofing is reliably maintained therein.

It is, with respect to skidproofing, preferable if in the method such a skidproofing material, of a suitable loose fibrous structure and inherent strength (preferably a nonwoven fabric), is provided, at least partly placed between the film sacks, which is capable of a suitable nonslip bond with the antislip protrusions due to its containing the elementary filaments or yarns in such a density and layer thickness at which a mechanical bond is formed between its elementary filaments or yarns and the antislip protrusions.

Details thereof have already been discussed at the aforementioned analogous solutions.

It is our object to present a new plastic film sack preferably applicable with the aforementioned method, based on the recognition presented hereinabove. The essence of our respective invention is a plastic film sack, suitable for the packaging of contents of powder form, comprising

- a flexible wall comprised of a plastic film,
  - the wall having an outer surface,
- the wall having at least one airing area comprising airing orifices, of suitable size and closeness, penetrating through the wall, the plastic film sack, in accordance with the invention, being such as at least a part of the outer surface of its flexible wall, the so-called roughened surface-part, comprises antislip protrusions which antislip protrusions are constituted by roughening particles (preferably granules), of polymer material, fixed to the outer surface and the height, above the outer surface of the plastic film wall, of at least a part of the antislip protrusions is bigger than one fortieth (preferably one thirtieth, more preferably one twentieth, even more preferably one tenth) of the size of at least a part of the airing orifices.

The features of the airing area and airing orifices have already been discussed above.

This sack is advantageous because it is suitable for forming such airing stacks in which the skidproofing can reliably be maintained.

With analogy to what has been mentioned above, it is preferable if the plastic film sack is such as in at least one vertical section, taken during a horizontal state of the outer surface, of at least a part of its antislip protrusions one or both of the leftmost and rightmost points of the antislip protrusion are at a greater free distance from the outer surface than one fortieth (preferably one thirtieth, more preferably one twentieth, even more preferably one tenth) of the size of at least a part of the airing orifices.

It is, with respect to skidproofing, preferable if an aforementioned plastic film sack is such as it has a skidproofing material of a suitable loose fibrous structure and inherent strength (preferably a nonwoven fabric), placed suitably to its outer surface, which is capable of a suitable nonslip bond with the antislip protrusions due to its containing the elementary filaments or yarns in such a density and layer thickness at which a mechanical bond is formed between its elementary filaments or yarns and the antislip protrusions.

It is our objective to present a new plastic film roll, advantageously applicable for making the sack described above, based on the recognition presented above. The essence of our respective invention is a plastic film roll, comprising a reel a plastic film, suitable for making a packaging sack, wound up in a longitudinal direction, in several coils around the reel, the plastic film having outer surfaces adjoining the neighbouring coils, the plastic film having one or more airing areas comprising airing orifices, of suitable size and closeness, penetrating through the wall and meeting at least one outer surface, the plastic film roll, in accordance with the invention, being such as its plastic film has one or more surface parts, the so-called roughened surface-parts, that comprise antislip protrusions which antislip protrusions are constituted by roughening particles (preferably granules), of polymer material, fixed to the outer surface and the height, above the outer surface of the plastic film wall, of at least a part of the antislip protrusions is bigger than one fortieth (preferably one thirtieth, more preferably one twentieth, even more preferably one tenth) of the size of at least a part of the airing orifices.

The reel may be hollow or solid, its material may be paper, plastic or any other suitable substance. The reel is the core of the roll, the long film becomes treatable, portable by being wound up thereon. The reel is most often a strong paper tube. The longitudinal direction of the roll is perpendicular to the axis of the reel. The plastic film of the film roll is formed wound up in the longitudinal direction around the reel. The plastic film is suitable for making a packaging sack, i.e., it is thick, strong and weldable enough for the particular application. The plastic film is wound up around the reel in multiple coils. Thus the film roll can be characterised by having been made with winding up a long film, in several coils, around a reel. The plastic film can be a flat film, a tube, a tube slit at one side (a so-called half-tube), a side gusseted tube or such a variation of any of these as has been formed with a folding along longitudinal folding lines, but it can be of any other suitable form. One coil, as is clear for the skilled person, contains that complete section of the long, single-layer or multiple-layer film whose length is the circumference of the coil. All parts of the given section of the long film, for example in case of a film tube both walls of the given section of the tube, form parts of the same coil in the film roll. The outer surfaces in the plastic film roll, contacting the neighbouring coils, can be detached from the aforementioned neighbouring coils via unwinding the film, e.g. film tube, from the roll. On the contrary, however, for example the inner surface of a film tube, laid flat, is in touch with the inner surface opposing it and being in the same coil independently from a winding up or an unwinding. In the airing area there are airing orifices leading out to the outer surface of the film and penetrating through the film thereby making it possible to let the air out from the sacks, formed later. Being aware of a particular application, the skilled person will be able to apply airing orifices of suitable size and closeness that let out much enough air but sufficiently retain the contents. It is important that the airing orifices should be small enough and of a sufficiently low closeness in order that the tearing parameters (primarily e.g., the tear strength) of the film remain good enough even in the airing area.

This film roll is advantageous because it is suitable for forming such airing film sacks with which the skidproofing can reliably be maintained during stacking.

With analogy to what has been mentioned above, it is preferable if the aforementioned plastic film roll is such as in at least one vertical section, taken during a horizontal state of the outer surface, of at least a part of its antislip protrusions one or both of the leftmost and rightmost points of the antislip protrusion are at a greater free distance from the outer surface than one fortieth (preferably one thirtieth, more preferably one twentieth, even more preferably one tenth) of the size of at least a part of the airing orifices.

It is, with respect to skidproofing, preferable if an aforementioned plastic film roll is such as it has a skidproofing material of a suitable loose fibrous structure and inherent strength (preferably a nonwoven fabric), placed suitably to its outer surface, which is capable of a suitable nonslip bond with the antislip protrusions due to its containing the elementary filaments or yarns in such a density and layer thickness at which a mechanical bond is formed between its elementary filaments or yarns and the antislip protrusions.

A BRIEF DESCRIPTION OF THE DRAWINGS

DESCRIPTION OF THE PREFERRED EMBODIMENTS

Example 1

Figure 1:
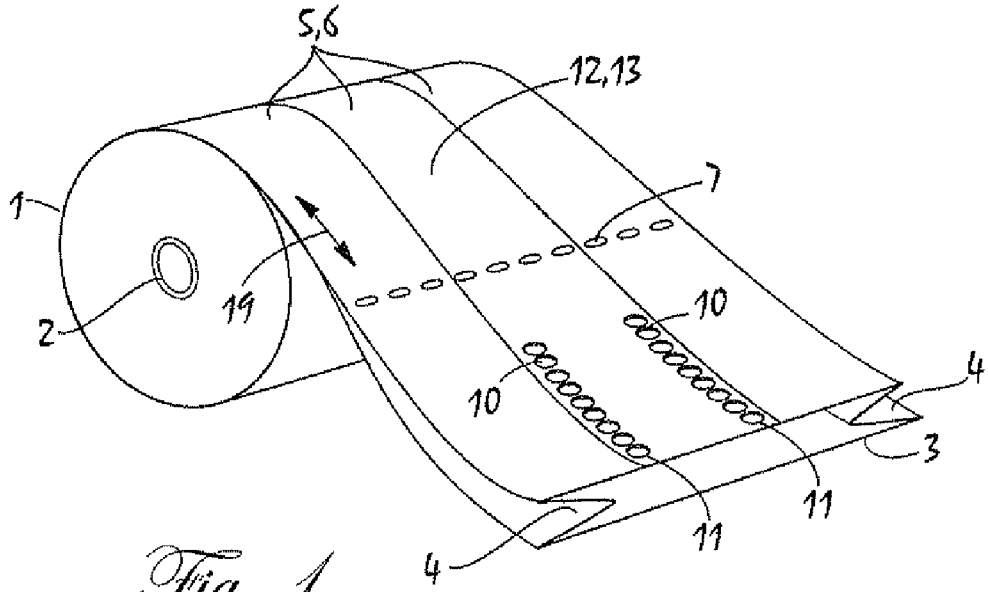
FIG. 1 is a perspective view of a plastic film roll.
Figure 2:
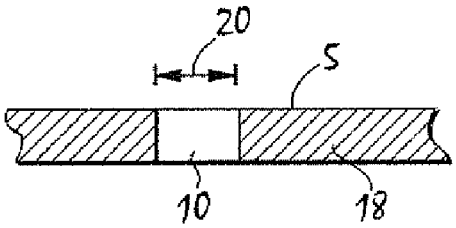
FIG. 2 is an airing orifice in section.
Figure 3:
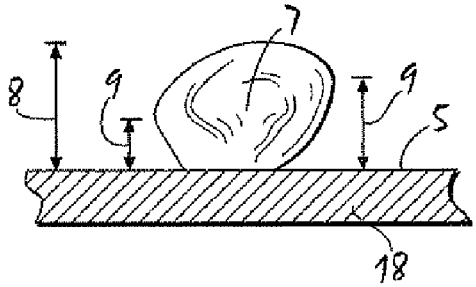
FIG. 3 is the side view of an antislip protrusion with the section of the plastic film wall.
Figure 4:
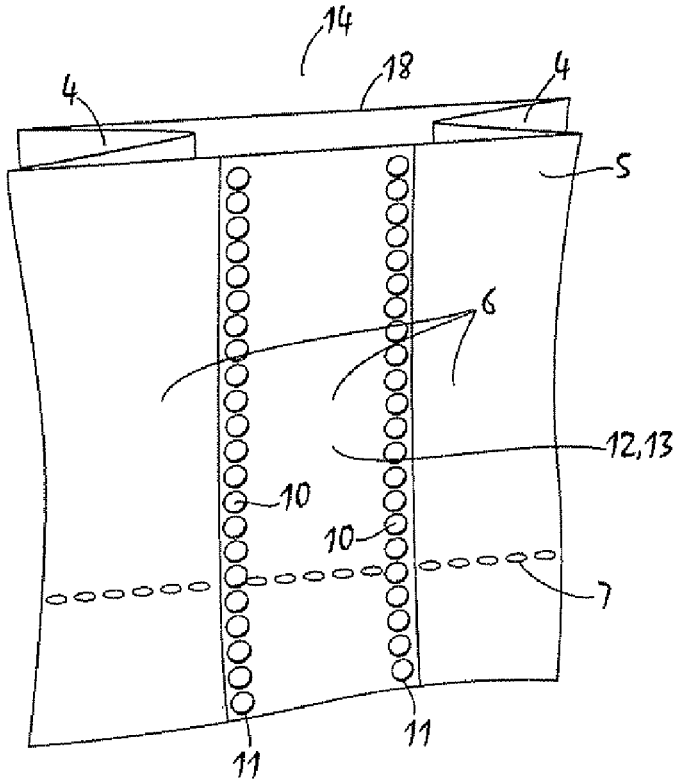
FIG. 4 is a perspective view of a plastic film sack.
Figure 5:
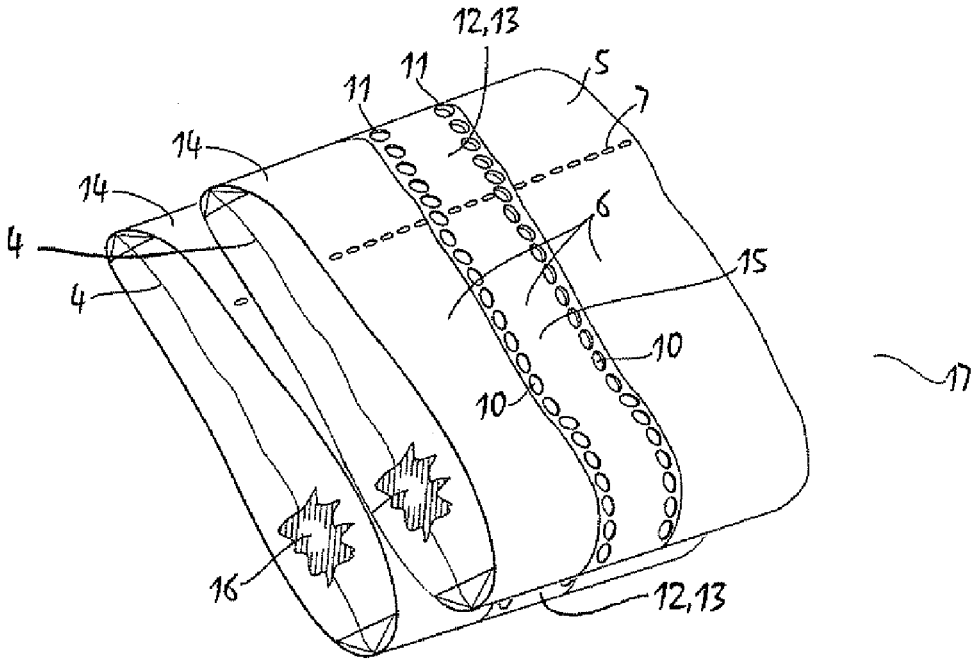
FIG. 5 is a perspective view of a filled package.

A Plastic Film Roll (See the Drawings)

The plastic film roll 1 comprises plastic film 3 wound up in a longitudinal direction 19 around a paper reel 2. The plastic film 3 is a side gusseted tube of polyethylene whose wall 18 is 150 microns thick. In an empty, layflat state of the tube the distance between the two outer edges, being along the side gussets 4, i.e., the width of the tube is 400 mm's.

The entire outer surface 5 of the plastic film 3 is a roughened surface-part 6, and comprises antislip protrusions 7. The latter are constituted by granules of polyethylene, welded to the outer surface 5. The closeness, in the surface, of the antislip protrusions 7 is 600 pieces per 100 square cm's, and the height 8 of the antislip protrusions 7 above the outer surface 5 of the plastic film 3 is 240 microns in average. In at least one view, taken from a horizontal direction during a horizontal state of the outer surface 5, of most of the antislip protrusions 7, both of the leftmost and rightmost points of the antislip protrusion 7 are at a greater free distance 9 from the outer surface 5 than 90 microns.

In one of the main outer surfaces 5, adjoining the neighbouring coils, of the tube-form plastic film 3, at a distance of 55 mm's in either direction from the longitudinal centre line between the side gussets 4, along two, respective, lines parallel with the longitudinal centre line there are two, respective, lines of airing orifices 10. The airing orifices 10 are round shaped perforations of a size 20, diameter, of 80 microns, penetrating through the plastic film 3, meeting the respective outer surface 5, located along the aforementioned line at a distance of 20 mm's from each other.

There is a nonwoven fabric 12 of a width of 150 mm's, as a skidproofing material 13, adhered, with a continuous filament of adhesive material, to the outer surface 5, including the airing area 11, of the plastic film 3. The nonwoven fabric 12 has a surface weight of 14 g/m$^2$ and has a great inherent strength, tear strength. The nonwoven fabric 12 is of a sufficiently loose fibrous structure and contains the infinite polypropylene elementary filaments in such a density and layer thickness that between its elementary filaments and the antislip protrusions 7 a mechanical bond, withstanding a very strong shearing load, is formed. The antislip protrusions 7 are suitable for an appropriate antislip engagement with the nonwoven fabric 12 due to their being of a size and shape, suitable for penetrating between the elementary filaments of the nonwoven fabric 12 to such an extent that a mechanical bond is created between the elementary filaments and the antislip protrusions 7.

Example 2

A Plastic Film Sack (See the Drawings)

The plastic film sack 14 is a side gusseted sack of a height of 900 mm's, made from the tube of plastic film 3 of Example 1, with a crosswise-cutting and welding thereof.

Example 3

A Method for Treating a Package (See the Drawings)

As a first plastic film sack 14 such a plastic film sack 14 is provided which is identical with the plastic film sack 14 described in Example 2 and which has a lower main abutting surface 15, laid on which the filled plastic film sack 14 can be stored, and an opposing, upper main abutting surface 15 including the airing area 11. The nonwoven fabric 12 forming the skidproofing material 13 is fixed to the upper main abutting surface 15. A second plastic film sack 14, identical in parameters with the first plastic film sack 14, is provided. As a product of powder form 16, a mixture of cement and fine sand, a so-called dry-mix concrete powder, is provided, the particle size of 1 mass-percent of which is smaller than 1 micron and the particle size of 1 mass-percent of which is bigger than 2100 microns, and is packed into the plastic film sacks 14. One of the, reliably skidproof, packages 17 formed thereby is placed upon the other, either in a columnar way or with an overlap. Meanwhile, their upper main abutting surfaces 15 are kept turned upwards.

Example 4

A Method for Treating a Package

The method differs from that of Example 3 in that unperforated plastic film sacks, free of airing orifices, are applied.

Example 5

A Method for Treating a Package

The method differs from that of Example 4 in that plastic film sacks free of an adhered-on nonwoven fabric are applied, whose entire outer surface is roughened with antislip protrusions, and a stick-sheet, comprising a nonwoven fabric of a surface weight of 35 g/m$^2$, is placed between the packages put on top of each other. The nonwoven fabric is of a sufficiently loose fibrous structure and contains the infinite polypropylene elementary filaments in such a density and layer thickness that between its elementary filaments and the antislip protrusions a mechanical bond, withstanding a very strong shearing load, is formed.

INDEX OF SIGNS OF THE FIGURES

1 plastic film roll
2 reel
3 plastic film
4 side gusset
5 outer surface
6 roughened surface-part
7 antislip protrusion
8 height of antislip protrusion above the outer surface
9 free distance
10 airing orifice
11 airing area
12 nonwoven fabric
13 skidproofing material
14 plastic film sack
15 main abutting surface of plastic film sack
16 product of powder form
17 package
18 wall
19 longitudinal direction
20 size of airing orifice

The invention claimed is:

1. A method for treating a package, the method comprising the steps of:

providing a product of a powder form, the product including a plurality of particles, wherein a major fraction of the particles have sizes between lower and upper size limits and a minor fraction of the particles have sizes below the lower size limit, the minor fraction of the particles comprising 1 mass percent of the particles;

providing a first plastic film sack having a flexible wall comprising a plastic film, the wall having an outer surface and a roughened surface part comprising antislip protrusions fixed to at least a part of the outer surface of the first plastic film sack, at least some of the antislip protrusions each having at least one undercut and including a projection to the outer surface that is bigger than its intersection with the outer surface, and at least some of the antislip protrusions with the at least one undercut including at least one area immediately above the undercut, the at least some of the antislip protrusions with the at least one undercut being so dimensioned as to form a separation between the at least one area and the outer surface which is greater in size than the lower size limit;

packing the product of the powder form in the first plastic film sack; and at least partly placing the first plastic film sack upon a second plastic film sack.

2. The method according to claim 1, further comprising the steps of:

providing a skidproofing material, of a suitable loose fibrous structure and inherent strength; and at least partly placing the skidproofing material between the first and second film sacks, the skidproofing material being capable of a nonslip bond with the antislip protrusions, the skidproofing material including elementary filaments or yarns in a density and layer thickness at which a mechanical bond is formed between the elementary filaments or yarns and the antislip protrusions.

3. The method according to claim 1, wherein the wall of the first plastic film sack includes one or more airing orifices.

4. The method according to claim 1, wherein the wall of the first plastic film sack is free from airing orifices.

5. The method according to claim 1, wherein the antislip protrusions comprise granules or powder granules fixed to the outer surface.

6. The method according to claim 1, wherein the antislip protrusions comprise granules or powder granules of polymer material fixed to the outer surface.

7. A method for treating a package, the method comprising the steps of:

providing a product of a powder form, the product at least partly including particles of a size which is smaller than 3 microns;

providing a first plastic film sack having a flexible wall comprising a plastic film, the wall having an outer surface and a roughened surface part comprising antislip protrusions fixed to at least a part of the outer surface of the first plastic film sack, at least some of the antislip protrusions each having at least one undercut and at least some antislip protrusions with the at least one undercut including at least one area immediately above the undercut, the at least some of the antislip protrusions with the at least one undercut being so dimensioned as to form a separation between the at least one area and the outer surface which is greater than 12 microns;

packing the product of the powder form in the first plastic film sack; and at least partly placing the first plastic film sack upon a second plastic film sack.

8. The method according to claim 7, further comprising the steps of:

providing a skidproofing material, of a suitable loose fibrous structure and inherent strength; and at least partly placing the skidproofing material between the first and second film sacks, the skidproofing material being capable of a nonslip bond with the antislip protrusions, the skidproofing material including elementary filaments or yarns in a density and layer thickness at which a mechanical bond is formed between the elementary filaments or yarns and the antislip protrusions.

9. The method according to claim 7, wherein the wall of the first plastic film sack includes one or more airing orifices.

10. The method according to claim 7, wherein the wall of the first plastic film sack is free from airing orifices.

11. The method according to claim 7, wherein the antislip protrusions comprise granules or powder granules fixed to the outer surface.

12. The method according to claim 7, wherein the antislip protrusions comprise granules or powder granules of polymer material fixed to the outer surface.

13. A method for treating a package, the method comprising the steps of:

providing a product of a powder form, the product including a plurality of particles, wherein a major fraction of the particles have sizes between lower and upper size limits and a minor fraction of the particles have sizes below the lower size limit, the minor fraction of the particles comprising 1 mass percent of the particles;

and providing a plastic film sack for packing the product of the powder form, the plastic film sack having a flexible wall comprising a plastic film, the wall having an outer surface and a roughened surface part comprising antislip protrusions fixed to at least a part of the outer surface of the plastic film sack, at least some of the antislip protrusions each having at least one undercut and including a projection to the outer surface that is bigger than its intersection with the outer surface, and at least some of the antislip protrusions with the at least one undercut including at least one area immediately above the undercut, the at least some of the antislip protrusions with the at least one undercut being so dimensioned as to form a separation between the at least one area and the outer surface which is greater in size than the lower size limit.

14. The method according to claim 13, wherein the wall of the plastic film sack includes one or more airing orifices.

15. The method according to claim 13, wherein the wall of the plastic film sack is free from airing orifices.

16. The method according to claim 13, wherein the antislip protrusions comprise granules or powder granules fixed to the outer surface.

17. The method according to claim 13, wherein the antislip protrusions comprise granules or powder granules of polymer material fixed to the outer surface.

18. A method for treating a package, the method comprising the steps of:

providing a product of a powder form, the product at least partly including particles of a size which is smaller than 3 microns; and providing a plastic film sack for packing the product of the powder form, the plastic film sack having a flexible wall comprising a plastic film, the wall having an outer surface and a roughened surface part comprising antislip protrusions fixed to at least a part of the outer surface of the plastic film sack, at least some of the antislip protrusions each having at least one undercut and at least some antislip protrusions with the at least one undercut including at least one area immediately above the undercut, the at least some of the antislip protrusions with the at least one undercut being so dimensioned as to form a separation between the at least one area and the outer surface which is greater than 12 microns.

19. The method according to claim 18, wherein the wall of the plastic film sack includes one or more airing orifices.

20. The method according to claim 18, wherein the wall of the plastic film sack is free from airing orifices.

21. The method according to claim 18, wherein the antislip protrusions comprise granules or powder granules fixed to the outer surface.

22. The method according to claim 18, wherein the antislip protrusions comprise granules or powder granules of polymer material fixed to the outer surface.

23. A method for treating a package, the method comprising the steps of:

providing a product of a powder form, the product including a plurality of particles, wherein a major fraction of the particles have sizes between lower and upper size limits and a minor fraction of the particles have sizes below the lower size limit, the minor fraction of the particles comprising 1 mass percent of the particles;

providing a plastic film sack, the plastic film sack having a flexible wall comprising a plastic film, the wall having an outer surface and a roughened surface part comprising antislip protrusions fixed to at least a part of the outer surface of the plastic film sack, at least some of the antislip protrusions each having at least one undercut and including a projection to the outer surface that is bigger than its intersection with the outer surface, and at least some of the antislip protrusions with the at least one undercut including at least one area immediately above the undercut, the at least some of the antislip protrusions with the at least one undercut being so dimensioned as to form a separation between the at least one area and the outer surface which is greater in size than the lower size limit; and packing the product of the powder form in the plastic film sack.

24. The method according to claim 23, wherein the wall of the plastic film sack includes one or more airing orifices.

25. The method according to claim 23, wherein the wall of the plastic film sack is free from airing orifices.

26. The method according to claim 23, wherein the antislip protrusions comprise granules or powder granules fixed to the outer surface.

27. The method according to claim 23, wherein the antislip protrusions comprise granules or powder granules of polymer material fixed to the outer surface.

28. A method for treating a package, the method comprising the steps of:

providing a product of a powder form, the product at least partly including particles of a size which is smaller than 3 microns;

providing a plastic film sack, the plastic film sack having a flexible wall comprising a plastic film, the wall having an outer surface and a roughened surface part comprising antislip protrusions fixed to at least a part of the outer surface of the plastic film sack, at least some of the antislip protrusions each having at least one undercut and at least some antislip protrusions with the at least one undercut including at least one area immediately above the undercut, the at least some of the antislip protrusions with the at least one undercut being so dimensioned as to form a separation between the at least one area and the outer surface which is greater than 12 microns; and packing the product of the powder form in the plastic film sack.

29. The method according to claim 28, wherein the wall of the plastic film sack includes one or more airing orifices.

30. The method according to claim 28, wherein the wall of the plastic film sack is free from airing orifices.

31. The method according to claim 28, wherein the antislip protrusions comprise granules or powder granules fixed to the outer surface.

32. The method according to claim 28, wherein the antislip protrusions comprise granules or powder granules of polymer material fixed to the outer surface.

* * * * *